United States Patent [19]

Kawai et al.

[11] Patent Number: 4,851,819

[45] Date of Patent: Jul. 25, 1989

[54] PHOTOELECTRIC SMOKE DETECTOR WITH PERMANENTLY FIXED INSECT NET

[75] Inventors: Hironobu Kawai, Sagamihara; Hiroshi Sawa, Machida, both of Japan

[73] Assignee: Hochiki Kabushiki Kaisha, Tokyo, Japan

[21] Appl. No.: 168,149

[22] Filed: Mar. 15, 1988

[30] Foreign Application Priority Data

Mar. 27, 1987 [JP] Japan ..... 62-73158

[51] Int. Cl.[4] ..... G08B 17/10

[52] U.S. Cl. ..... 340/630; 340/628; 250/574

[58] Field of Search ..... 340/630, 628, 629; 250/574–577; 356/439

[56] References Cited

U.S. PATENT DOCUMENTS

| | | | |
|---|---|---|---|
| 3,905,063 | 9/1975 | Coulter et al. | 340/630 |
| 3,908,957 | 9/1975 | Schütt | 250/384 |
| 3,930,247 | 12/1975 | Hurd | 340/628 |
| 3,935,466 | 1/1976 | Tomioka | 340/628 |
| 4,017,733 | 4/1977 | Ishii et al. | 250/381 |
| 4,121,110 | 10/1978 | Solomon | 340/630 |
| 4,124,298 | 11/1978 | Steele | 250/574 |
| 4,129,383 | 12/1978 | Malinowski | 250/574 |
| 4,234,877 | 11/1980 | Maruyama et al. | 340/629 |
| 4,439,683 | 3/1984 | Dobrzanski | 258/381 |
| 4,473,848 | 9/1984 | Juergensen | 250/228 |
| 4,672,217 | 6/1987 | Dobrzanski | 250/574 |
| 4,758,733 | 7/1988 | Mochizuki | 250/574 |

FOREIGN PATENT DOCUMENTS

| | | | |
|---|---|---|---|
| 1490273 | 7/1967 | France | 340/630 |

*Primary Examiner*—Joseph A. Orsino
*Assistant Examiner*—Jill D. Jackson
*Attorney, Agent, or Firm*—Max Fogiel

[57] ABSTRACT

A photoelectric smoke detector of this invention comprises a smoke-detection arrangement including a light emitting element and a photodetecting element and a smoke-detecting unit on which said smoke-detection arrangement is mounted. The smoke-detecting unit includes a base plate to which said smoke-detection arrangement is attached and a peripheral wall having such a configuration that allows smoke to enter from the outside, but substantially prevents light to enter from the outside. The peripheral wall is formed of a plurality of wall elements, each of said wall elements is arranged substantially regularly and formed integrally with said base plate so as to extend downward from the base plate. The smoke-detecting unit further includes an insect net which has been fixed to the outer surfaces of the wall elements in the shaping process of the smoke-detecting unit so as to be fit around the outer periphery of the peripheral wall.

3 Claims, 4 Drawing Sheets

PHOTOELECTRIC SMOKE DETECTOR WITH PERMANENTLY FIXED INSECT NET

BACKGROUND OF THE INVENTION

This invention relates to a photoelectric smoke detector with a small-sized and thin-formed smoke-detecting unit.

A conventional photoelectric smoke detector, such as a scattered light smoke detector has a relatively bulky smoke detecting unit having a light emitting element and a photodetecting element, which is formed in a cylindrical shape having a relatively large diameter and a height. The smoke detecting unit is accommodated in a casing. The smoke detecting unit is comprised of the light emitting element and the photodetecting element, a base plate for mounting the elements thereon, and a peripheral wall provided so as to extend downward from the base plate, encasing the light emitting element and the photodetecting element therein. In general, the base plate and the peripheral wall are formed integrally with each other from a thermosetting synthetic resin.

The peripheral wall is comprised of wall elements which are planted circumferentially and allows smoke from the outside to enter but substantially prevents light from the outside from entering. The peripheral wall further contributes to substantial elimination of irregular reflection due to the internal configuration. The formation of the peripheral wall is what is called a labyrinth. If smoke enters inside of the peripheral wall, a portion of light emitted from the light emitting element is scattered by smoke particles. A fire detection output is generated when the scattered light is incident upon the photodetecting element and the output from the photodetecting element exceeds a threshold value indicative, for example, of a smoke density reached a danger level.

An insect net with is made of a perforated very thin metal plate to prevent possible intrusion by insects.

A conventional smoke detector of the type as described above, when installed on a ceiling of a room, is noticeably projected into the room, spoiling the scene. To solve this problem, there has been developed a scattered light smoke detector which has a small and thin smoke detecting unit having a reduced diameter and a height reduced to one third of the conventional detector height.

So far as the inventors know, this improved small and thin smoke detector is generally made of a thin material. For example, a base plate is made of a material as thin as 1mm or less. By this reason, a sufficient mechanical strength can not be ensured and, therefore, there may possibly be caused a problem that the base plate is inadvertently bent or, in the worst case, the base plate is broken. Besides, the wall elements are so fragile due to the thinned and small-sized configuration that the wall elements may possibly be bent if they are handled with special care, because the elements are not interconnected with each other.

In this connection, it is to be noted that the smoke detector of this type should clear a performance test subjecting the detector at atmosphere at a high temperature for a long time, for example 70° C. for 21 days according to the UL standards. If the smoke detecting unit made of a thin material is allowed to stand in such atmosphere, the unit is liable to get deformed due to an internal stress caused in the shaping process.

SUMMARY OF THE INVENTION

The present invention has been made to obviate the problems as described above, and it is an object of the present invention to provide a photoelectric smoke detector which is cabable of reducing the thicknesses of the base plate and the peripheral wall of the smoke detecting-unit, while being capable of ensuring a required mechanical strength and preventing possible breakage or deformation in the assembling process.

To achieve the object, the present invention contemplates that an insect net of a very thin metal sheet is fixed at least to the outer surface of the peripheral wall of the smoke-detecting unit during the shaping of the smoke-detecting unit.

More specifically, the present invention features a photoelectric smoke detector which comprises a smoke-detection arrangement including a light emitting element and a photodetecting element and a smoke-detecting unit on which said smoke-detection arrangement is mounted; said smoke-detecting unit including a base plate to which said smoke-detection arrangement is attached and a peripheral wall having a configuration which allows smoke to enter from the outside, but substantially prevents light to enter from the outside; said peripheral wall being formed of a plurality of wall elements, each of said wall elements being arranged substantially regularly and formed integrally with said base plate so as to extend downward from the base plate; and said smoke-detecting unit further including an insect net which has been fixed to the other surfaces of the wall elements during the shaping process of the smoke-detecting unit so as to be fit around the outer periphery of the peripheral wall.

In a preferred embodiment, the insect net is further stuck, at its upper end, in the base plate.

In another preferred embodiment, a circumferential end edge of the insect net is buried under a lower surface of the base plate.

In a still further preferred embodiment, the outer surfaces of the wall elements are set while being intruded the openings of the insect net.

With this arrangement, the photoelectric smoke detector of the present invention has sufficient mechanical strength at the peripheral wall of the smoke-detecting unit by the insect net fixed to the outer surface of the wall. In addition, possible inadvertent bending or breakage of the peripheral wall in the assembling process or in high temperature atmosphere can be surely prevented.

PREFERRED EMBODIMENTS

Figure 1:
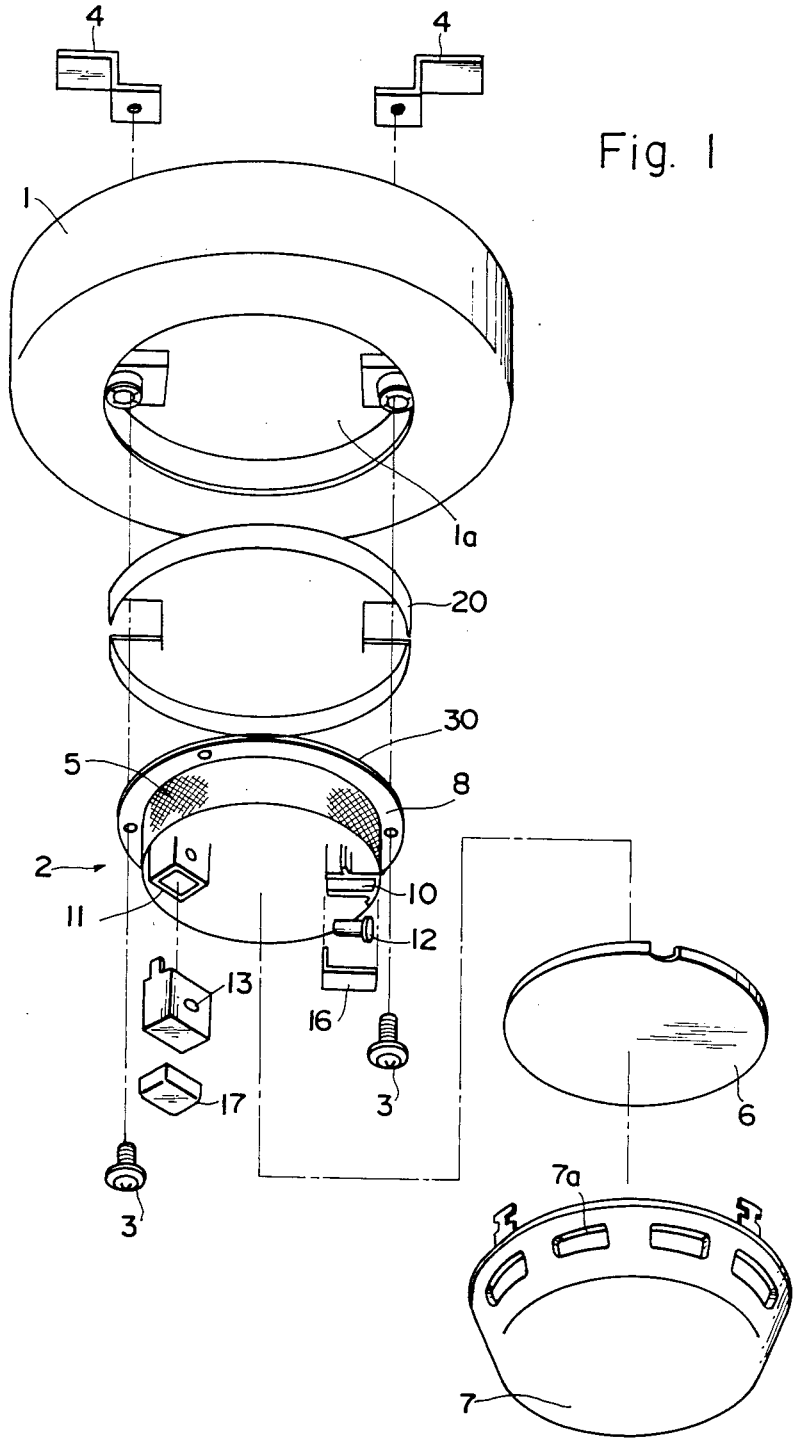
FIG. 1 is an exploded perspective view of a photoelectric smoke detector according to the present invention.

Preferred embodiments of the present invention will now be described, while referring to the drawings.

Figure 2:
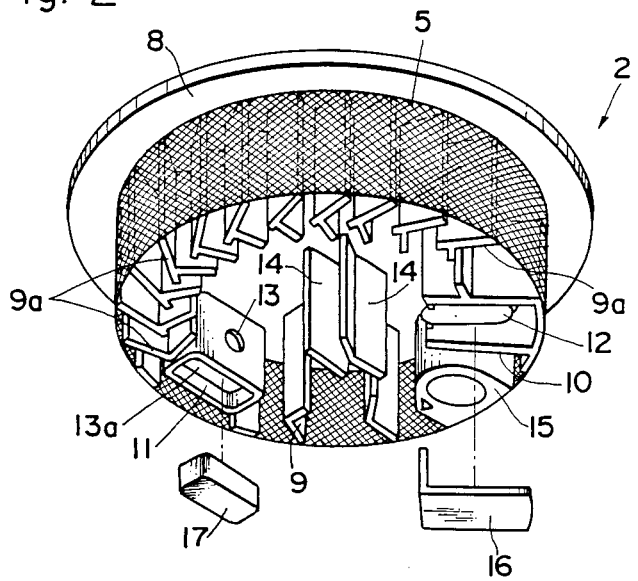
FIG. 2 is an enlarged perspective view of a smoke-detecting unit employed in the smoke detector of FIG. 1.
Figure 3:
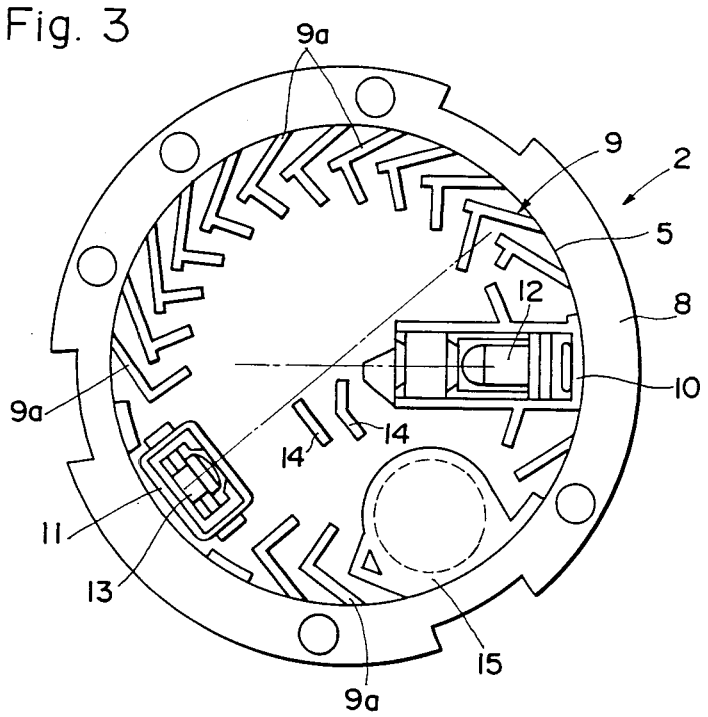
FIG. 3 is an enlarged plan view of the smoke-detecting unit shown in FIG. 2.

As illustrated in FIG. 1, a smoke-detecting unit 2 is fitted in a recessed portion 1a formed at a lower central portion of a casing 1 and fixed to brackets 4 disposed at the rear of the casing 1 by screws 3. The smoke-detecting unit 2 comprises, as illustrated in FIG. 2, a base plate 8 in the form of disc and a surrounding or peripheral wall 9. The smoke-detecting unit 2 is installed on a ceiling in such a manner that the peripheral wall 9 may be postured downward. A printed circuit board 30 with detector circuitry packaged thereon is laid on a base plate 8 and an insect net 5 is fitted to a lower side of the smoke-detecting unit 2. Upper side of the printed circuit board 30 is covered by an upper seal cover. An outer cover member 7 is fitted to the lower side of the base plate 8 through a cover member 6 interposed therebetween. The outer cover member 7 has a plurality of openings 7*a* for allowing smoke to enter the smoke-detecting unit 2.

The base plate 8 and the peripheral wall 9 are made of a thermosetting resin and formed integrally with each other. The base plate 8 is as thin as 1 mm thick. The peripheral wall 9 is formed of a plurality of wall elements 9*a*. Each of the wall elements 9*a* has an L-shaped section. The wall elements 9*a* are arranged circumferentially at predetermined intervals and extend downward from the base plate 8. This formation of the peripheral wall is what is called a labyrinth, which allows smoke to enter from the outside, but substantially prevents light from entering from the outside and suppresses internal light scattering within the smoke-detecting unit 2.

A light emitting unit holder 10, a photodetector unit holder 11 and a capacitor receptacle 15 are provided between the wall elements 9*a* of the peripheral wall 9. A light emitting element 12 such as LED is accomplished in the light emitting unit holder 10 and a photodetector 13 such as a photosensor is accomplished in the photodetecting unit holder 11. A capacitor packaged on the printed circuit board 30 assembled on the base plate 8 is received in the capacitor receptacle 15. Since a scattered light smoke detector is contemplated in the embodiment as illustrated, the photodetector 13 is disposed at a position out of an optical axis of the light emitting element 12 and shading plates 14, 14 are provided in the vicinity of the intersection of the optical axis of the photodetector 13 and the light emitting element 12 for preventing direct incidence of light as illustrated in FIG. 2. Numerals 16 and 17 designate covers fitted on the light emitting unit holder 10 and the photo-detecting unit holder 11.

Figure 6:
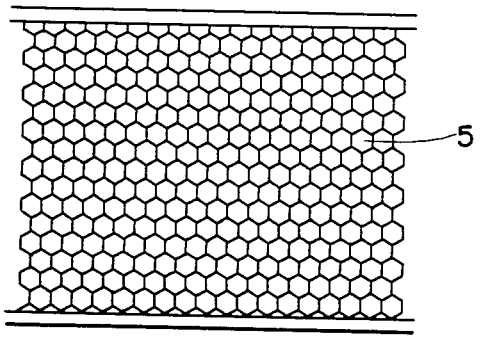
FIG. 6 is an enlarged plan view showing the insect net.

An insect net 5 is fitted around the peripheral of the peripheral wall 9. The insect net 5 is made of a very thin metal sheet which has been perforated to have a number of hexagonal openings as illustrated in FIG. 6. The insect net 5 is rounded in a cylinder as illustrated in FIG. 2 and fixed to the peripheral wall 9.

Figure 4:
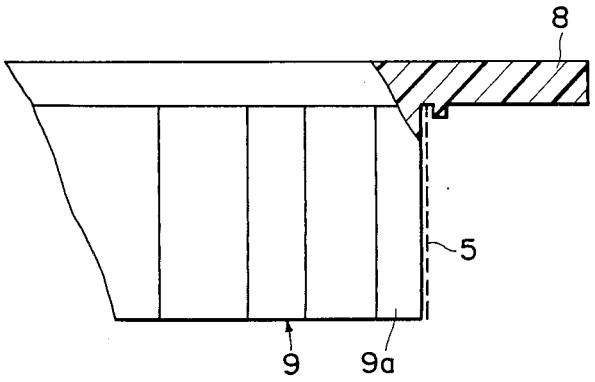
FIG. 4 is a fragmentary view showing partly in section a fixing arrangment of an insect net relative to a peripheral wall and a base plate.
Figure 5:
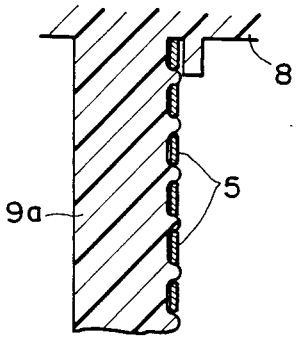
FIG. 5 is a sectional view showing, in an enlarged scale, a principal portion of the members shown in FIG. 4.

The fixation of the insect net 5 to the peripheral wall 9 is made simultaneously with the shaping of the smoke-detecting unit 2 of a synthetic resin. More specifically, the insect net 5 is placed in a mold for shaping the wall elements, at a position just outside of the portion where the wall elements 9*a* are to be shaped. Thereafter, a material resin is injected into the mold to form the smoke-detecting unit 2 (see FIG. 4). The resin for forming the outer periphery of the wall elements 9*a* is then set while being intruded into and filling the openings of the insect net 5 as shown in FIG. 5. As a result of this, the insect net 5 is fixed to the wall elements 9*a* and rendered integral therewith. In the embodiment as illustrated, the insect net 5 is also fixed to the outer walls of the light emitting unit holder 10 and the capacitor receptacle 15. As the insect net 5 is thus fixed during the shaping process, an operator for mounting the insect net 5 onto the smoke-detecting detecting unit 5 can be omitted. Thus, the assembling operation of the smoke detector can be simplified.

Figure 7:
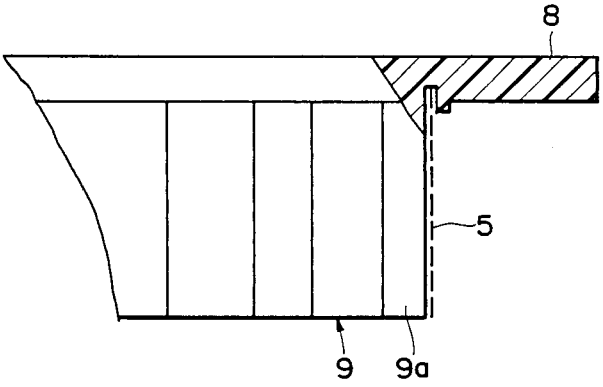
FIG. 7 is a sectional view similar to FIG. 4, showing partly in section another fixing arrangement of an insect net relative to a peripheral wall and a base plate.

FIG. 7 illustrates another manner for incorporating the insect net 5 into the smoke-detecting unit 2. In this embodiment, the insect net 5 is not only fixed to the outer surfaces of the peripheral wall 9, but also stuck, at an end edge thereof, in the base plate 8. In the embodiment as illustrated in FIG. 7, therefore, the height of the insect net 5 is larger than that of each of the wall elements 9*a* by a length corresponding to the stuck depth of the net 5 in the base plate 8.

We claim:

1. A photoelectric smoke detector comprising a smoke-detection arrangement including a light emitting element, a photodetecting element, and a smoke-detecting unit on which said smoke-detection arrangement is mounted;

said smoke-detecting unit having a base plate attached to said smoke-detection arrangement; a peripheral wall having a shape for allowing smoke to enter from the outside, but substantially preventing light from entering from the outside;

said peripheral wall comprising a plurality of wall elements, each of said wall elements being arranged substantially regularly and formed integrally with said base plate so as to extend downward from said base plate; and said smoke-detecting unit further including an insect net fixed to the outer surfaces of the wall elements and being integral with the wall elements for fitting around the outer periphery of the peripheral wall;

said wall elements having outer surfaces extending and permanently into openings of the insect net.

2. A photoelectric smoke detector as defined in claim 1, wherein said insect net is secured, at its upper end, in said base plate.

3. A photoelectric smoke detector as defined in claim 1, wherein said insect net has an upper circumferential end edge embedded under a lower surface of said base plate.

* * * * *